US009595155B2

(12) United States Patent
Englman et al.

(10) Patent No.: US 9,595,155 B2
(45) Date of Patent: Mar. 14, 2017

(54) WAGERING GAME WITH TRAIL-BASED BONUS GAME HAVING PLAYER-SELECTABLE FEATURES

(75) Inventors: Allon G. Englman, Chicago, IL (US); Benjamin T. Gomez, Chicago, IL (US); Michael W. Mastropietro, Chicago, IL (US); Bradley A. Rose, Chicago, IL (US)

(73) Assignee: Bally Gaming, Inc., Las Vegas, NV (US)

( * ) Notice: Subject to any disclaimer, the term of this patent is extended or adjusted under 35 U.S.C. 154(b) by 2265 days.

(21) Appl. No.: 12/306,221

(22) PCT Filed: Jun. 8, 2007

(86) PCT No.: PCT/US2007/013568

§ 371 (c)(1),
(2), (4) Date: Dec. 22, 2008

(87) PCT Pub. No.: WO2008/002387

PCT Pub. Date: Jan. 3, 2008

(65) Prior Publication Data

US 2009/0275389 A1 Nov. 5, 2009

Related U.S. Application Data

(60) Provisional application No. 60/816,507, filed on Jun. 26, 2006.

(51) Int. Cl.
*A63F 9/24* (2006.01)
*G07F 17/32* (2006.01)

(52) U.S. Cl.
CPC ..... *G07F 17/32* (2013.01); *G07F 17/3267* (2013.01)

(58) Field of Classification Search
CPC ..... G07F 17/32; G07F 17/3267
USPC ... 463/1, 6, 20, 21, 30; 273/138.1, 236, 337, 273/242, 246, 275
See application file for complete search history.

(56) References Cited

U.S. PATENT DOCUMENTS

| | | | | |
|---|---|---|---|---|
| 2,026,082 | A * | 12/1935 | Darrow | 273/256 |
| 5,865,676 | A * | 2/1999 | Salley | 463/6 |
| 6,645,073 | B2 | 11/2003 | Lemay et al. | 463/20 |
| 6,793,575 | B2 | 9/2004 | Brown et al. | 463/6 |
| 6,932,701 | B2 | 8/2005 | Glavich et al. | |
| 7,331,859 | B2 | 2/2008 | Hornik et al. | |
| 7,780,531 | B2 | 8/2010 | Englman et al. | |
| 2005/0020340 | A1 | 1/2005 | Cannon | 463/16 |
| 2007/0060317 | A1* | 3/2007 | Martin | 463/26 |
| 2008/0045341 | A1 | 2/2008 | Englman | |

OTHER PUBLICATIONS

International Search Report—PCT/US07/13568 dated Sep. 16, 2008 (2 pages).

* cited by examiner

*Primary Examiner* — David L Lewis
*Assistant Examiner* — Robert Mosser
(74) *Attorney, Agent, or Firm* — Nixon Peabody LLP

(57) ABSTRACT

A gaming system having an input device for receiving a wager to play a wagering game including a trail-based game. A display for displaying the trail-based game is also included. The trail-based game includes a plurality of elements along a trail. Each of the plurality of elements has an associated award. In response to a player meeting a predetermined criterion, the player is awarded the associated award for all of the plurality of elements.

14 Claims, 11 Drawing Sheets

WAGERING GAME WITH TRAIL-BASED BONUS GAME HAVING PLAYER-SELECTABLE FEATURES

CROSS-REFERENCE TO RELATED APPLICATIONS

This application is a U.S. national stage of International Application No. PCT/US2007/013568, filed Jun. 8, 2007, which is related to and claims priority to U.S. Provisional Application No. 60/816,507, filed Jun. 26, 2006, each of which is hereby incorporated by reference herein in its entirety.

FIELD OF THE INVENTION

The present invention relates generally to gaming machines, and methods for playing wagering games, and more particularly, to a gaming system having player-selectable elements.

BACKGROUND OF THE INVENTION

Gaming machines, such as slot machines, video poker machines and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning at each machine is roughly the same (or believed to be the same), players are likely to be attracted to the most entertaining and exciting machines. Shrewd operators consequently strive to employ the most entertaining and exciting machines, features, and enhancements available because such machines attract frequent play and hence increase profitability to the operator. Therefore, there is a continuing need for gaming machine manufacturers to continuously develop new games and improved gaming enhancements that will attract frequent play through enhanced entertainment value to the player.

One concept that has been successfully employed to enhance the entertainment value of a game is the concept of a "secondary" or "bonus" game that may be played in conjunction with a "basic" game. The bonus game may comprise any type of game, either similar to or completely different from the basic game, which is entered upon the occurrence of a selected event or outcome in the basic game. Generally, bonus games provide a greater expectation of winning than the basic game and may also be accompanied with more attractive or unusual video displays and/or audio. Bonus games may additionally award players with "progressive jackpot" awards that are funded, at least in part, by a percentage of coin-in from the gaming machine or a plurality of participating gaming machines. Because the bonus game concept offers tremendous advantages in player appeal and excitement relative to other known games, and because such games are attractive to both players and operators, there is a continuing need to develop gaming machines with new types of bonus games to satisfy the demands of players and operators.

SUMMARY OF THE INVENTION

According to one embodiment of the present invention, a gaming system having an input device for receiving a wager to play a wagering game including a trail-based game is provided. A display for displaying the trail-based game is also included. The trail-based game includes a plurality of elements along a trail, such that each of the plurality of elements has an associated award. In response to a player meeting a predetermined criterion, the player is awarded the associated award for all of the plurality of elements.

According to another embodiment of the present invention, a method of playing a wagering game at a gaming machine is provided. The method includes conducting the wagering game at the gaming machine. The wagering game is a trail-based game. The method also includes displaying a plurality of game elements, such that each of the game elements has an associated award. In response to a player achieving a predetermined criterion, the player is awarded all of the associated awards.

According to yet another embodiment of the present invention, a computer readable storage medium encoded with instructions for directing a gaming system to perform the above method is provided.

According to another embodiment of the present invention, a method of playing a wagering game at a gaming machine is provided. The wagering game is conducted at a plurality of gaming machines and the wagering game is a trail-based game. A plurality of game elements are displayed, each of the game elements has an associated award. A plurality of player-selectable elements are also displayed. The player-selectable elements have associated awards and location-related indicia that are associated with locations along the trail. One of the plurality of player-selectable elements is selected via a player at one of the plurality of gaming machines. Another of the plurality of player-selectable elements is assigned to one other of the plurality of gaming machines.

Additional aspects of the invention will be apparent to those of ordinary skill in the art in view of the detailed description of various embodiments, which is made with reference to the drawings, a brief description of which is provided below.

DESCRIPTION OF ILLUSTRATIVE EMBODIMENTS

Figure 1A:
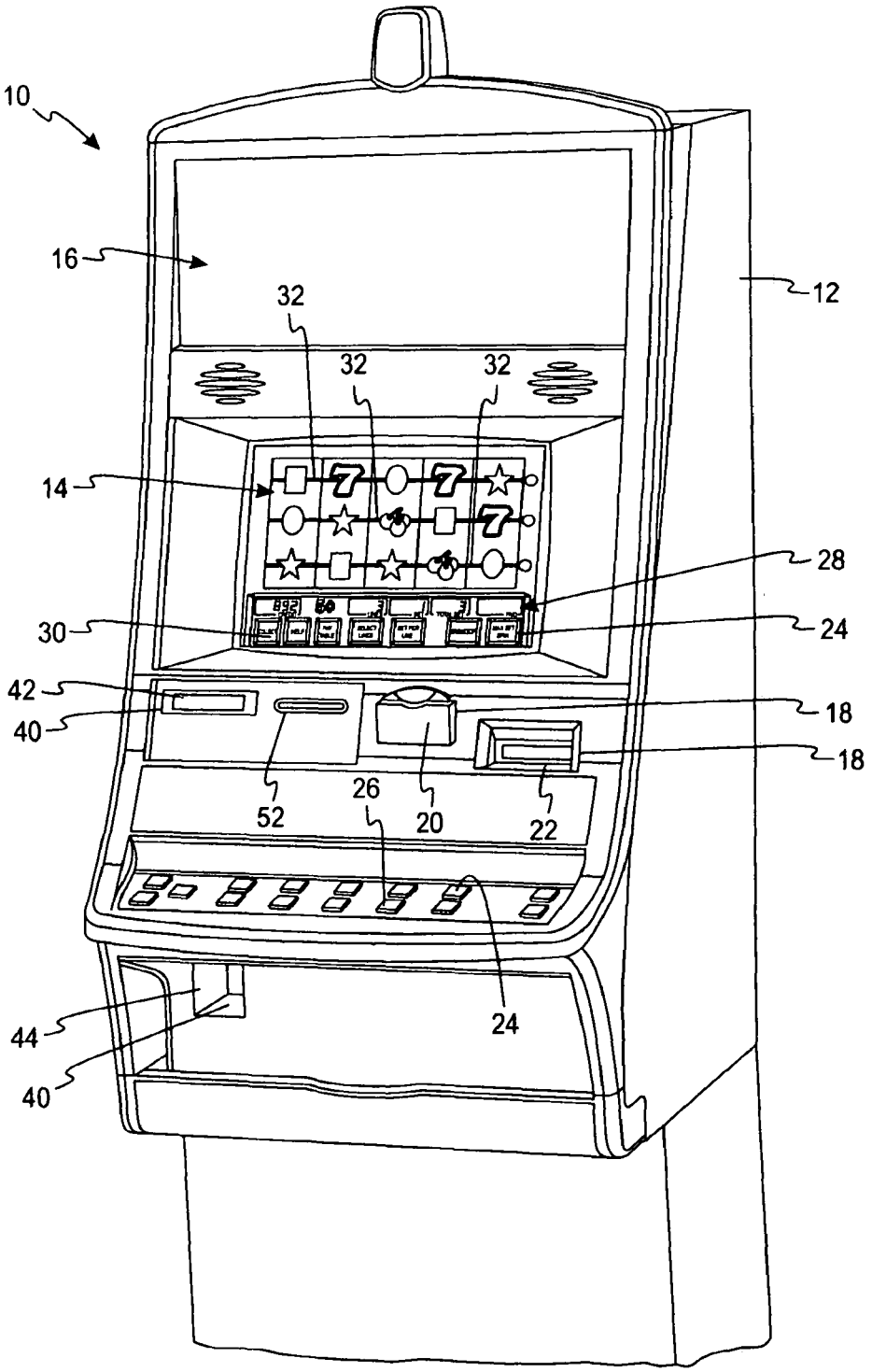
FIG. 1*a* is a perspective view of a free standing gaming machine embodying the present invention.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Referring to FIG. 1*a*, a gaming machine 10 is used in gaming establishments such as casinos. With regard to the present invention, the gaming machine 10 may be any type of gaming machine and may have varying structures and methods of operation. For example, the gaming machine 10 may be an electromechanical gaming machine configured to play mechanical slots, or it may be an electronic gaming machine configured to play a video casino game, such as blackjack, slots, keno, poker, blackjack, roulette, etc.

The gaming machine 10 comprises a housing 12 and includes input devices, including a value input device 18 and a player input device 24. For output the gaming machine 10 includes a primary display 14 for displaying information about the basic wagering game. The primary display 14 can also display information about a bonus wagering game and a progressive wagering game. The gaming machine 10 may also include a secondary display 16 for displaying game events, game outcomes, and/or signage information. While these typical components found in the gaming machine 10 are described below, it should be understood that numerous other elements may exist and may be used in any number of combinations to create various forms of a gaming machine 10.

The value input device 18 may be provided in many forms, individually or in combination, and is preferably located on the front of the housing 12. The value input device 18 receives currency and/or credits that are inserted by a player. The value input device 18 may include a coin acceptor 20 for receiving coin currency (see FIG. 1*a*). Alternatively, or in addition, the value input device 18 may include a bill acceptor 22 for receiving paper currency. Furthermore, the value input device 18 may include a ticket reader, or barcode scanner, for reading information stored on a credit ticket, a card, or other tangible portable credit storage device. The credit ticket or card may also authorize access to a central account, which can transfer money to the gaming machine 10.

The player input device 24 comprises a plurality of push buttons 26 on a button panel for operating the gaming machine 10. In addition, or alternatively, the player input device 24 may comprise a touch screen 28 mounted by adhesive, tape, or the like over the primary display 14 and/or secondary display 16. The touch screen 28 contains soft touch keys 30 denoted by graphics on the underlying primary display 14 and used to operate the gaming machine 10. The touch screen 28 provides players with an alternative method of input. A player enables a desired function either by touching the touch screen 28 at an appropriate touch key 30 or by pressing an appropriate push button 26 on the button panel. The touch keys 30 may be used to implement the same functions as push buttons 26. Alternatively, the push buttons 26 may provide inputs for one aspect of the operating the game, while the touch keys 30 may allow for input needed for another aspect of the game.

The various components of the gaming machine 10 may be connected directly to, or contained within, the housing 12, as seen in FIG. 1*a*, or may be located outboard of the housing 12 and connected to the housing 12 via a variety of different wired or wireless connection methods. Thus, the gaming machine 10 comprises these components whether housed in the housing 12, or outboard of the housing 12 and connected remotely.

The operation of the basic wagering game is displayed to the player on the primary display 14. The primary display 14 can also display the bonus game associated with the basic wagering game. The primary display 14 may take the form of a cathode ray tube (CRT), a high resolution LCD, a plasma display, an LED, or any other type of display suitable for use in the gaming machine 10. As shown, the primary display 14 includes the touch screen 28 overlaying the entire display (or a portion thereof) to allow players to make game-related selections. Alternatively, the primary display 14 of the gaming machine 10 may include a number of mechanical reels to display the outcome in visual association with at least one pay line 32. In the illustrated embodiment, the gaming machine 10 is an "upright" version in which the primary display 14 is oriented vertically relative to the player. Alternatively, the gaming machine may be a "slant-top" version in which the primary display 14 is slanted at about a thirty-degree angle toward the player of the gaming machine 10.

A player begins play of the basic wagering game by making a wager via the value input device 18 of the gaming machine 10. A player can select play by using the player input device 24, via the buttons 26 or the touch screen keys 30. The basic game consists of a plurality of symbols arranged in an array, and includes at least one pay line 32 that indicates one or more outcomes of the basic game. Such outcomes are randomly selected in response to the wagering input by the player. At least one of the plurality of randomly-selected outcomes may be a start-bonus outcome, which can include any variations of symbols or symbol combinations triggering a bonus game.

In some embodiments, the gaming machine 10 may also include a player information reader 52 that allows for identification of a player by reading a card with information indicating his or her true identity. The player information reader 52 is shown in FIG. 1*a* as a card reader, but may take on many forms including a ticket reader, bar code scanner, RFID transceiver or computer readable storage medium interface. Currently, identification is generally used by casinos for rewarding certain players with complimentary services or special offers. For example, a player may be enrolled in the gaming establishment's loyalty club and may be awarded certain complimentary services as that player collects points in his or her player-tracking account. The player inserts his or her card into the player information reader 52, which allows the casino's computers to register that player's wagering at the gaming machine 10. The gaming machine 10 may use the secondary display 16 or other dedicated player-tracking display for providing the player with information about his or her account or other player-specific information. Also, in some embodiments, the information reader 52 may be used to restore game assets that the player achieved and saved during a previous game session.

Figure 1B:
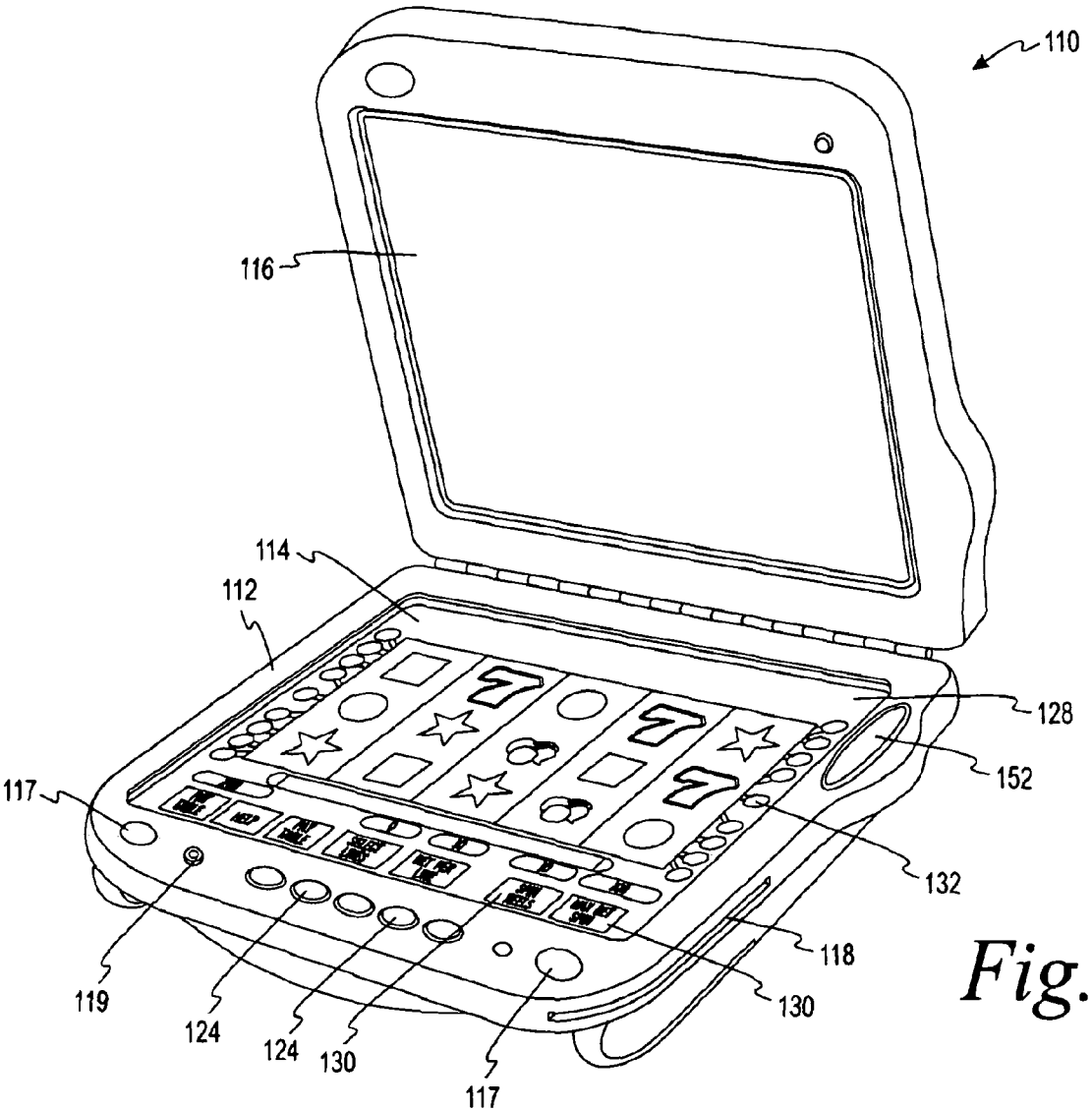
FIG. 1*b* is a perspective view of a handheld gaming machine embodying the present invention.

Depicted in FIG. 1*b* is a handheld or mobile gaming machine 110. Like the free standing gaming machine 10, the handheld gaming machine 110 is preferably an electronic gaming machine configured to play a video casino game such as, but not limited to, blackjack, slots, keno, poker, blackjack, and roulette. The handheld gaming machine 110 comprises a housing or casing 112 and includes input devices, including a value input device 118 and a player input device 124. For output the handheld gaming machine 110 includes, but is not limited to, a primary display 114, a secondary display 116, one or more speakers 117, one or more player-accessible ports 119 (e.g., an audio output jack for headphones, a video headset jack, etc.), and other conventional I/O devices and ports, which may or may not be player-accessible. In the embodiment depicted in FIG. 1*b*, the handheld gaming machine 110 comprises a secondary display 116 that is rotatable relative to the primary display 114. The optional secondary display 116 may be fixed, movable, and/or detachable/attachable relative to the primary display 114. Either the primary display 114 and/or secondary display 116 may be configured to display any aspect of a non-wagering game, wagering game, secondary games, bonus games, progressive wagering games, group games, shared-experience games or events, game events, game outcomes, scrolling information, text messaging, emails, alerts or announcements, broadcast information, subscription information, and handheld gaming machine status.

The player-accessible value input device 118 may comprise, for example, a slot located on the front, side, or top of the casing 112 configured to receive credit from a stored-value card (e.g., casino card, smart card, debit card, credit card, etc.) inserted by a player. In another aspect, the player-accessible value input device 118 may comprise a sensor (e.g., an RF sensor) configured to sense a signal (e.g., an RF signal) output by a transmitter (e.g., an RF transmitter) carried by a player. The player-accessible value input device 118 may also or alternatively include a ticket reader, or barcode scanner, for reading information stored on a credit ticket, a card, or other tangible portable credit or funds storage device. The credit ticket or card may also authorize access to a central account, which can transfer money to the handheld gaming machine 110.

Still other player-accessible value input devices 118 may require the use of touch keys 130 on the touch-screen display (e.g., primary display 114 and/or secondary display 116) or player input devices 124. Upon entry of player identification information and, preferably, secondary authorization information (e.g., a password, PIN number, stored value card number, predefined key sequences, etc.), the player may be permitted to access a player's account. As one potential optional security feature, the handheld gaming machine 110 may be configured to permit a player to only access an account the player has specifically set up for the handheld gaming machine 110. Other conventional security features may also be utilized to, for example, prevent unauthorized access to a player's account, to minimize an impact of any unauthorized access to a player's account, or to prevent unauthorized access to any personal information or funds temporarily stored on the handheld gaming machine 110.

The player-accessible value input device 118 may itself comprise or utilize a biometric player information reader which permits the player to access available funds on a player's account, either alone or in combination with another of the aforementioned player-accessible value input devices 118. In an embodiment wherein the player-accessible value input device 118 comprises a biometric player information reader, transactions such as an input of value to the handheld device, a transfer of value from one player account or source to an account associated with the handheld gaming machine 110, or the execution of another transaction, for example, could all be authorized by a biometric reading, which could comprise a plurality of biometric readings, from the biometric device.

Alternatively, to enhance security, a transaction may be optionally enabled only by a two-step process in which a secondary source confirms the identity indicated by a primary source. For example, a player-accessible value input device 118 comprising a biometric player information reader may require a confirmatory entry from another biometric player information reader 152, or from another source, such as a credit card, debit card, player ID card, fob key, PIN number, password, hotel room key, etc. Thus, a transaction may be enabled by, for example, a combination of the personal identification input (e.g., biometric input) with a secret PIN number, or a combination of a biometric input with a fob input, or a combination of a fob input with a PIN number, or a combination of a credit card input with a biometric input. Essentially, any two independent sources of identity, one of which is secure or personal to the player (e.g., biometric readings, PIN number, password, etc.) could be utilized to provide enhanced security prior to the electronic transfer of any funds. In another aspect, the value input device 118 may be provided remotely from the handheld gaming machine 110.

The player input device 124 comprises a plurality of push buttons on a button panel for operating the handheld gaming machine 110. In addition, or alternatively, the player input device 124 may comprise a touch screen 128 mounted to a primary display 114 and/or secondary display 116. In one aspect, the touch screen 128 is matched to a display screen having one or more selectable touch keys 130 selectable by a user's touching of the associated area of the screen using a finger or a tool, such as a stylus pointer. A player enables a desired function either by touching the touch screen 128 at an appropriate touch key 130 or by pressing an appropriate push button 126 on the button panel. The touch keys 130 may be used to implement the same functions as push buttons 126. Alternatively, the push buttons may provide inputs for one aspect of the operating the game, while the touch keys 130 may allow for input needed for another aspect of the game. The various components of the handheld gaming machine 110 may be connected directly to, or contained within, the casing 112, as seen in FIG. 1*b*, or may be located outboard of the casing 112 and connected to the casing 112 via a variety of hardwired (tethered) or wireless connection methods. Thus, the handheld gaming machine 110 may comprise a single unit or a plurality of interconnected parts (e.g., wireless connections) which may be arranged to suit a player's preferences.

The operation of the basic wagering game on the handheld gaming machine 110 is displayed to the player on the primary display 114. The primary display 114 can also display the bonus game associated with the basic wagering game. The primary display 114 preferably takes the form of a high resolution LCD, a plasma display, an LED, or any other type of display suitable for use in the handheld gaming machine 110. The size of the primary display 114 may vary from, for example, about a 2-3" display to a 15" or 17" display. In at least some aspects, the primary display 114 is a 7"-10" display. As the weight of and/or power requirements of such displays decreases with improvements in technology, it is envisaged that the size of the primary display may be increased. Optionally, coatings or removable films or sheets may be applied to the display to provide desired characteristics (e.g., anti-scratch, anti-glare, bacterially-resistant and anti-microbial films, etc.). In at least some embodiments, the primary display 114 and/or secondary display 116 may have a 16:9 aspect ratio or other aspect ratio (e.g., 4:3). The primary display 114 and/or secondary display 116 may also each have different resolutions, different color schemes, and different aspect ratios.

As with the free standing gaming machine 10, a player begins play of the basic wagering game on the handheld gaming machine 110 by making a wager (e.g., via the value input device 18 or an assignment of credits stored on the handheld gaming machine via the touch screen keys 130, player input device 124, or buttons 126) on the handheld gaming machine 10. In at least some aspects, the basic game may comprise a plurality of symbols arranged in an array, and includes at least one pay line 132 that indicates one or more outcomes of the basic game. Such outcomes are randomly selected in response to the wagering input by the player. At least one of the plurality of randomly selected outcomes may be a start-bonus outcome, which can include any variations of symbols or symbol combinations triggering a bonus game.

In some embodiments, the player-accessible value input device 118 of the handheld gaming machine 110 may double as a player information reader 152 that allows for identification of a player by reading a card with information indicating the player's identity (e.g., reading a player's credit card, player ID card, smart card, etc.). The player information reader 152 may alternatively or also comprise a bar code scanner, RFID transceiver or computer readable storage medium interface. In one presently preferred aspect, the player information reader 152, shown by way of example in FIG. 1, comprises a biometric sensing device.

Figure 2:
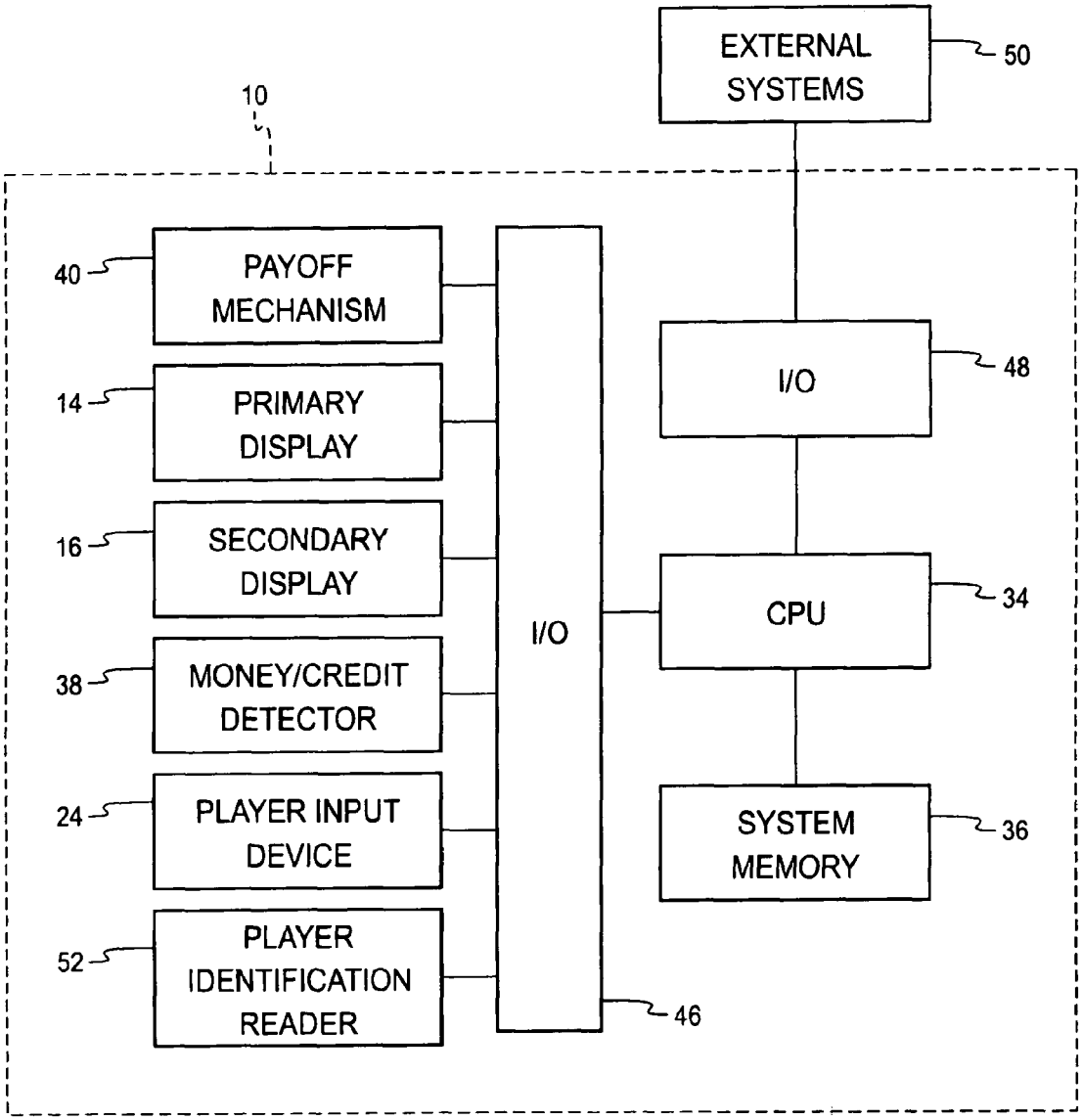
FIG. 2 is a block diagram of a control system suitable for operating the gaming machines of FIGS. 1*a* and 1*b;*

Turning now to FIG. 2, the various components of the gaming machine 10 are controlled by a central processing unit (CPU) 34, also referred to herein as a controller or processor (such as a microcontroller or microprocessor). To provide gaming functions, the controller 34 executes one or more game programs stored in a computer readable storage medium, in the form of memory 36. The controller 34 performs the random selection (using a random number generator (RNG)) of an outcome from the plurality of possible outcomes of the wagering game. Alternatively, the random event may be determined at a remote controller. The remote controller may use either an RNG or pooling scheme for its central determination of a game outcome. It should be appreciated that the controller 34 may include one or more microprocessors, including but not limited to a master processor, a slave processor, and a secondary or parallel processor.

The controller 34 is also coupled to the system memory 36 and a money/credit detector 38. The system memory 36 may comprise a volatile memory (e.g., a random-access memory (RAM)) and a non-volatile memory (e.g., an EEPROM). The system memory 36 may include multiple RAM and multiple program memories. The money/credit detector 38 signals the processor that money and/or credits have been input via the value input device 18. Preferably, these components are located within the housing 12 of the gaming machine 10. However, as explained above, these components may be located outboard of the housing 12 and connected to the remainder of the components of the gaming machine 10 via a variety of different wired or wireless connection methods.

As seen in FIG. 2, the controller 34 is also connected to, and controls, the primary display 14, the player input device 24, and a payoff mechanism 40. The payoff mechanism 40 is operable in response to instructions from the controller 34 to award a payoff to the player in response to certain winning outcomes that might occur in the basic game or the bonus game(s). The payoff may be provided in the form of points, bills, tickets, coupons, cards, etc. For example, in FIG. 1, the payoff mechanism 40 includes both a ticket printer 42 and a coin outlet 44. However, any of a variety of payoff mechanisms 40 well known in the art may be implemented, including cards, coins, tickets, smartcards, cash, etc. The payoff amounts distributed by the payoff mechanism 40 are determined by one or more pay tables stored in the system memory 36.

Communications between the controller 34 and both the peripheral components of the gaming machine 10 and external systems 50 occur through input/output (I/O) circuits 46, 48. More specifically, the controller 34 controls and receives inputs from the peripheral components of the gaming machine 10 through the input/output circuits 46. Further, the controller 34 communicates with the external systems 50 via the I/O circuits 48 and a communication path (e.g., serial, parallel, IR, RC, 10bT, etc.). The external systems 50 may include a gaming network, other gaming machines, a gaming server, communications hardware, or a variety of other interfaced systems or components. Although the I/O circuits 46, 48 may be shown as a single block, it should be appreciated that each of the I/O circuits 46, 48 may include a number of different types of I/O circuits.

Controller 34, as used herein, comprises any combination of hardware, software, and/or firmware that may be disposed or resident inside and/or outside of the gaming machine 10 that may communicate with and/or control the transfer of data between the gaming machine 10 and a bus, another computer, processor, or device and/or a service and/or a network. The controller 34 may comprise one or more controllers or processors. In FIG. 2, the controller 34 in the gaming machine 10 is depicted as comprising a CPU, but the controller 34 may alternatively comprise a CPU in combination with other components, such as the I/O circuits 46, 48 and the system memory 36. The controller 34 may reside partially or entirely inside or outside of the machine 10. The control system for a handheld gaming machine 110 may be similar to the control system for the free standing gaming machine 10 except that the functionality of the respective on-board controllers may vary.

The gaming machines 10, 110 may communicate with external systems 50 (in a wired or wireless manner) such that each machine operates as a "thin client," having relatively less functionality, a "thick client," having relatively more functionality, or through any range of functionality therebetween (e.g., a "rich client"). As a generally "thin client," the gaming machine may operate primarily as a display device to display the results of gaming outcomes processed externally, for example, on a server as part of the external systems 50. In this "thin client" configuration, the server executes game code and determines game outcomes (e.g., with a random number generator), while the controller 34 on board the gaming machine processes display information to be displayed on the display(s) of the machine. In an alternative "rich client" configuration, the server determines game outcomes, while the controller 34 on board the gaming machine executes game code and processes display information to be displayed on the display(s) of the machines. In yet another alternative "thick client" configuration, the controller 34 on board the gaming machine 110 executes game code, determines game outcomes, and processes display information to be displayed on the display(s) of the machine. Numerous alternative configurations are possible such that the aforementioned and other functions may be performed onboard or external to the gaming machine as may be necessary for particular applications. It should be understood that the gaming machines 10, 110 may take on a wide variety of forms such as a free standing machine, a portable or handheld device primarily used for gaming, a mobile telecommunications device such as a mobile telephone or personal daily assistant (PDA), a counter top or bar top gaming machine, or other personal electronic device such as a portable television, MP3 player, entertainment device, etc.

Figure 3:
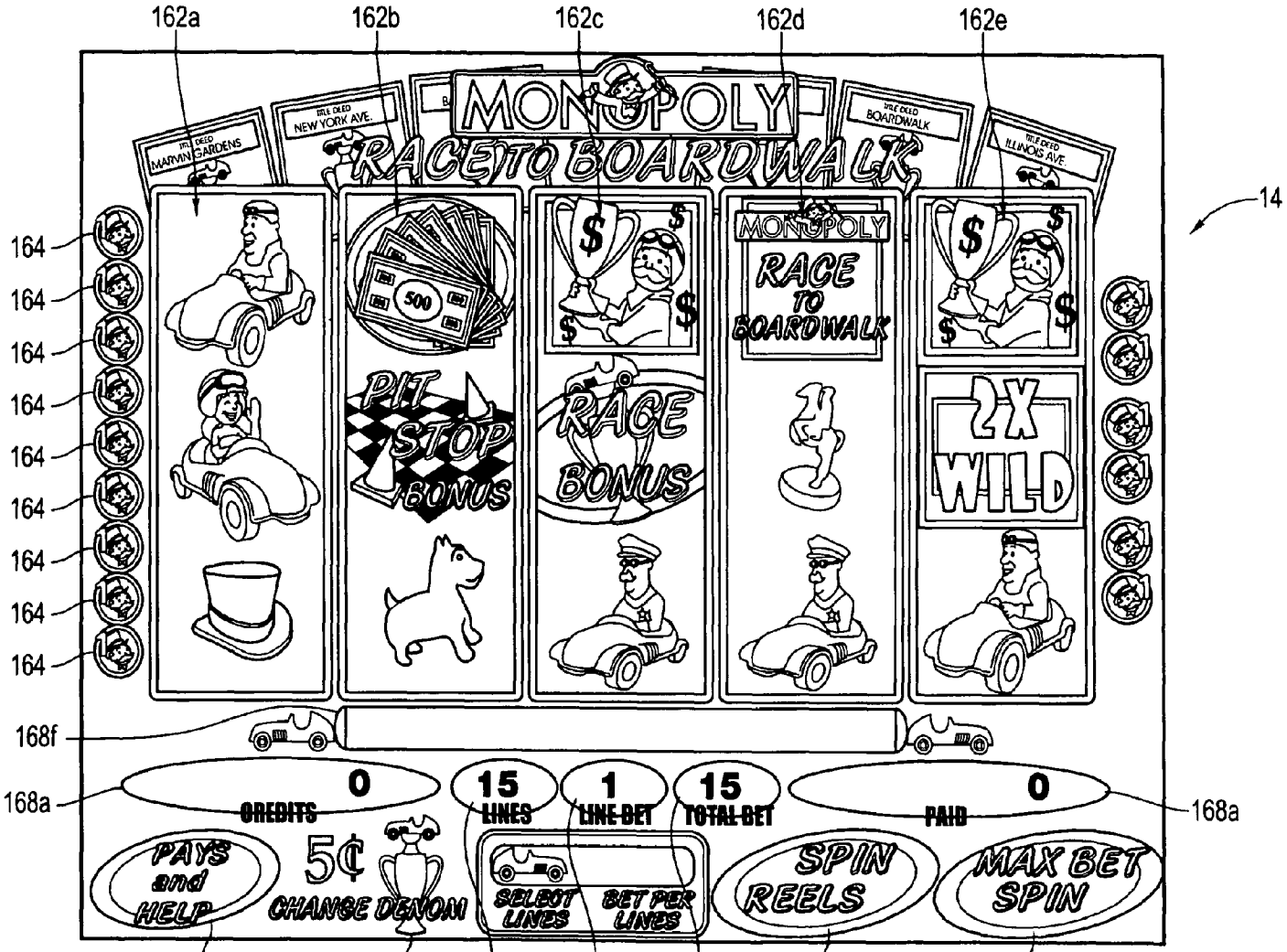
FIG. 3 is a display of a basic game according to one embodiment of the present invention.

Turning now to FIG. 3, the primary display 14 according to one embodiment of the present invention is illustrated. In this embodiment, the basic game is a slot machine game, with symbols on five different reels 162*a*, 162*b*, 162*c*, 162*d*, 162*e*. The reels 162*a*, 162*b*, 162*c*, 162*d*, 162*e* may be either traditional mechanical reels, electromechanical reels, or they may be computer-generated images of reels, with each reel composed of a plurality of symbols. In this embodiment, there are multiple pay lines represented by pay line indicators 164 across the various reels 162*a*, 162*b*, 162*c*, 162*d*, 162*e*. While multiple pay lines are shown, a gaming machine 10 having a single pay line will also work with the present invention.

During the basic game, the player places a wager on any number of pay lines. In the illustrated embodiment, the wager may be between one and five credits per pay line. However, in other embodiments, other wager amounts may be made. Once the player has placed the wager, the reels 162*a*, 162*b*, 162*c*, 162*d*, 162*e* begin to spin. As illustrated in FIG. 3, near the bottom of the display 14 are a plurality of keys 166*a*, 166*b*, 166*c*, 166*d*, 166*e* that enable the player to perform various functions, such as, select the pay lines to play, select a wager amount, and spin the reels. Outcome indicators 168*a*, 168*b*, 168*c*, 168*d*, 168*e*, 168*f* are located above the keys 166*a*, 166*b*, 166*c*, 166*d*, 166*e* and provide the player with information such as the amount of the current wager, the amount won, and the total number of credits remaining. Outcome indicator 168*f* may be used to display personalized or spin-specific information such as a personalized greeting or an indication that the spin was a winning spin.

Figure 4:
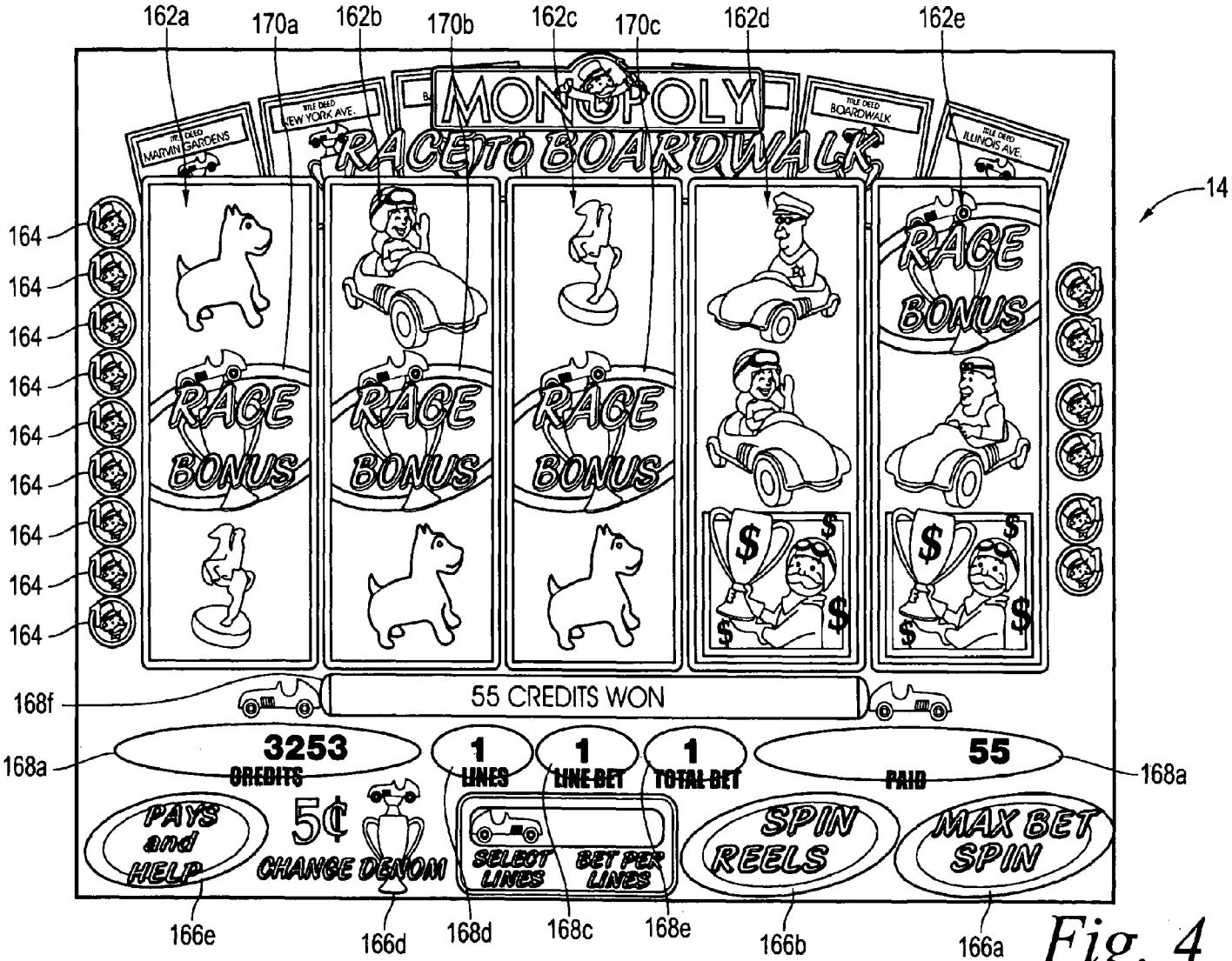
FIG. 4 is another display of the basic game.

Turning now to FIG. 4, another outcome of the basic game is illustrated. In this embodiment, the outcome includes three race-bonus symbols 170*a*, 170*b*, 170*c* in the first three reels 162*a*, 162*b*, 162*c*. Having the three race bonus symbols 170*a*, 170*b*, 170*c* aligned along an active pay line (one that has been selected and wagered on by the player), starts a race bonus game. The race bonus game may be a trail-based game, such as a MONOPOLY® game or other board-type game with a start position and a finish position. In other embodiments, the trail-based game is a racing game, with a start position and a finish position.

Figure 10:
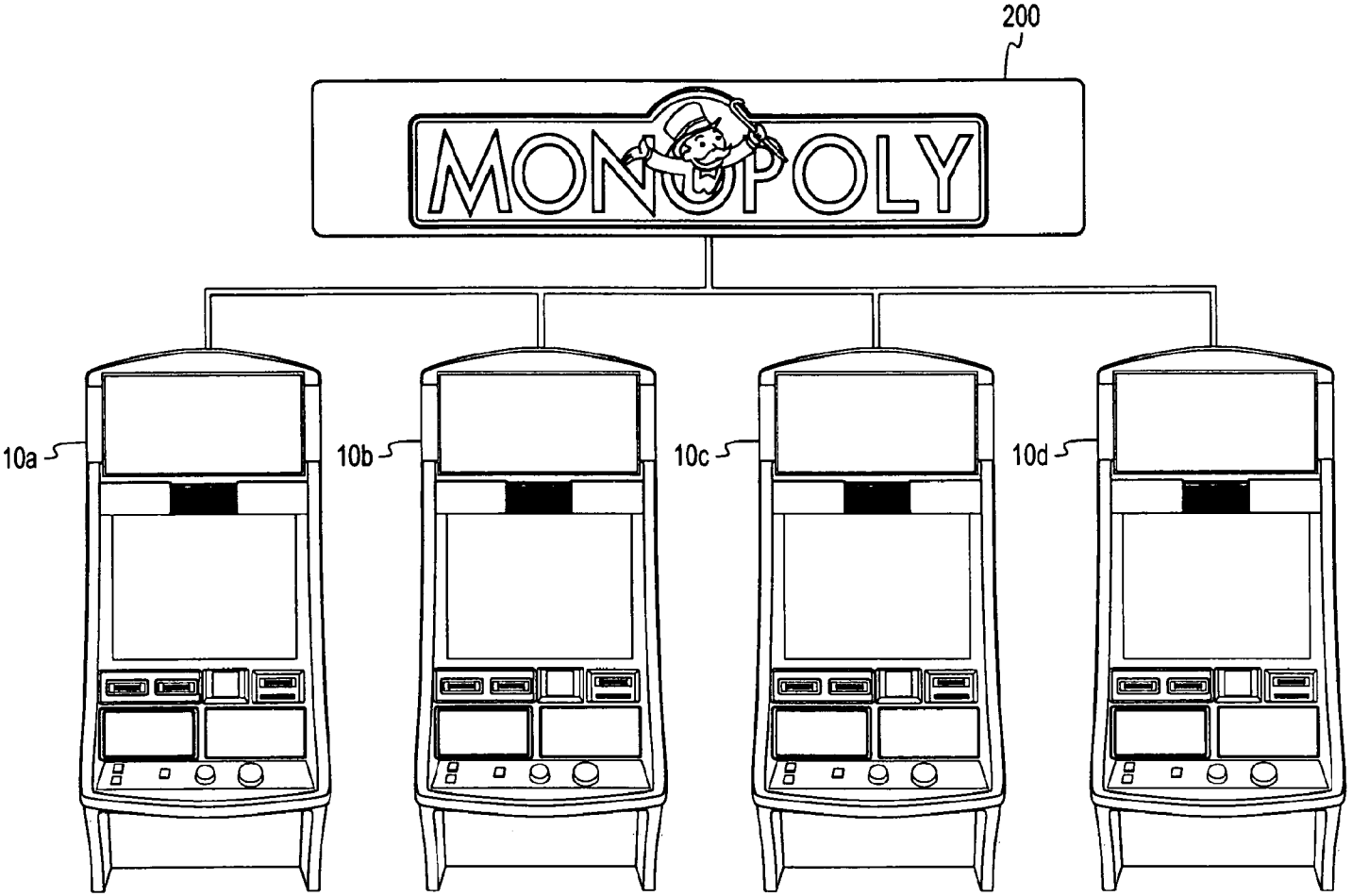
FIG. 10 is a perspective view of a gaming system having a plurality of gaming machines according to one embodiment of the present invention.

In some embodiments, after the player enters the bonus game, players at other gaming machines are also invited to play the bonus game such that the bonus game is a community event or community game. The other gaming machines may be in the same bank, or group, of gaming machines as the winning gaming machine 10 (as gaming machines 10*a*, 10*b*, 10*c*, 10*d* in FIG. 10), or the other gaming machines may be randomly selected.

Figure 5:
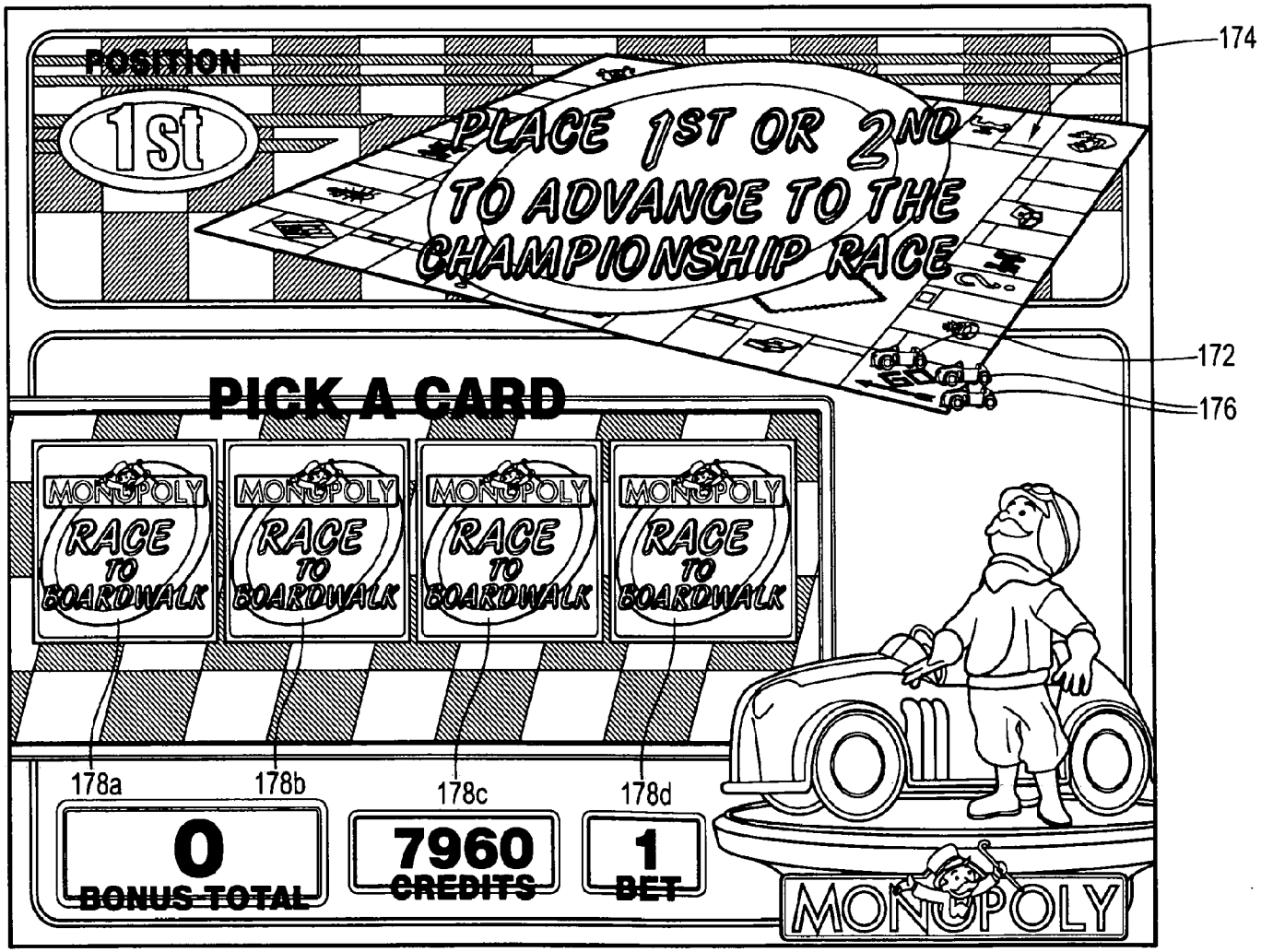
FIG. 5 is a display of a bonus game according to one embodiment of the present invention.

FIG. 5 illustrates the race bonus game in which the player must move his/her car 172 (or other token) around a MONOPOLY® board 174. The MONOPOLY® board 174 includes a plurality of game elements, or properties, that represent positions along the trail. Each property has an associated award, which in this embodiment is a number of credits.

In the trail-based game, the player's car 172 is in a race against other cars 176. In the embodiments where other players are invited to join, the other cars 176 belong to, or represent, the other players in the community game. In other embodiments, the other cars represent computer opponents and are operated by the CPU 34 of the gaming machine 10 or by a controller in the external systems 50 (FIG. 2).

To move the car 172, the player selects a player-selectable element. In the illustrated embodiment of FIG. 5, the player-selectable elements are represented as a group of cards 178*a*, 178*b*, 178*c*, 178*d*. The selected card 178*a* (in FIG. 6) states to advance three properties, so the player's car 172 moves forward three properties. The player is awarded the property and any credits corresponding to that property. In some embodiments, once a player is awarded a property, that player may receive additional awards if other players land on that property (e.g. "rent"). In some other embodiments, once a player has landed on a property, players that subsequently land on that property will not be granted an award. Alternatively, in other embodiments, players that subsequently land on that property will still receive the award associated with that property.

Figure 6:
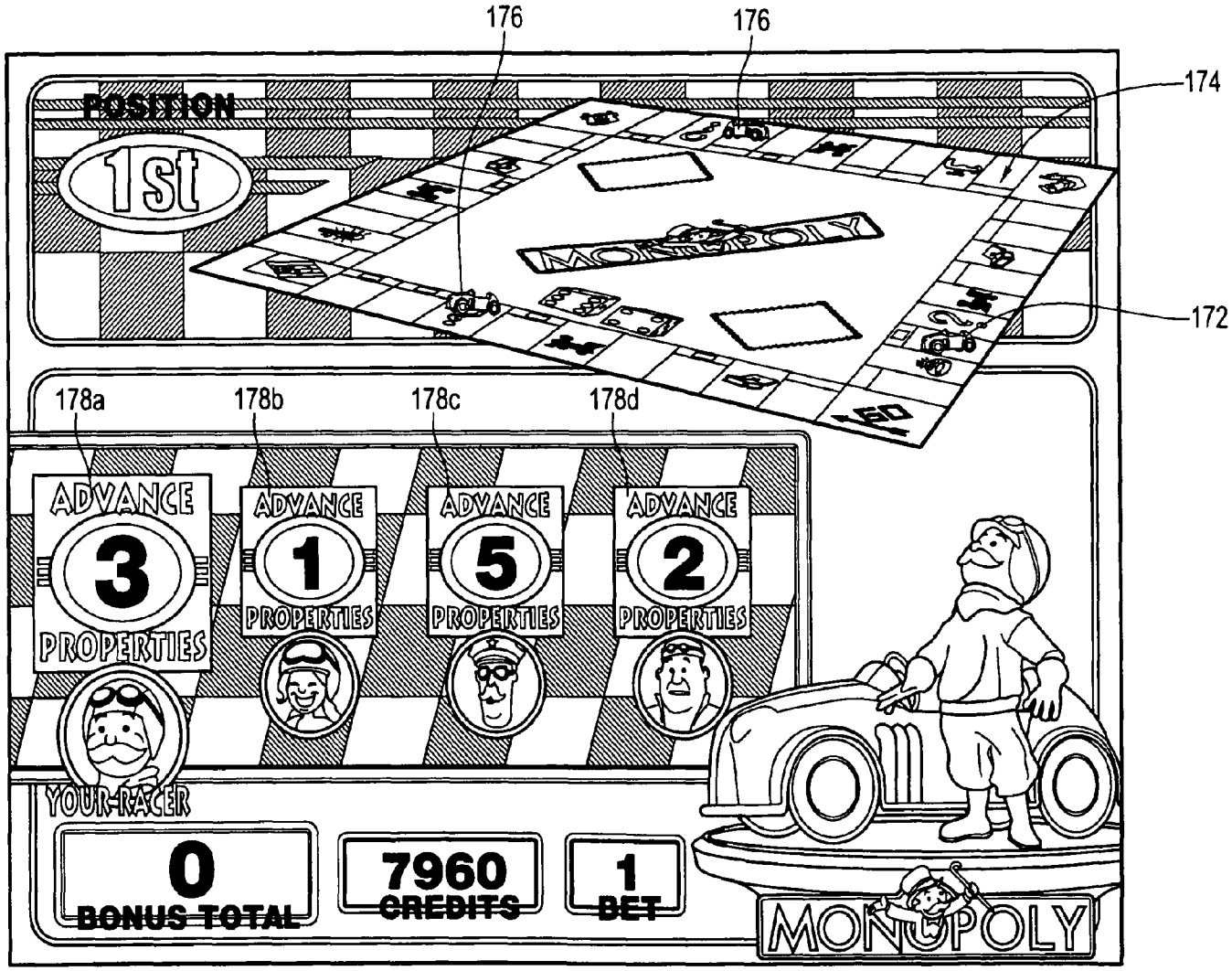
FIG. 6 is a subsequent display of the bonus game of FIG. 5.

In some embodiments, the other cards 178*b*, 178*c*, 178*d* are randomly distributed to the other players. In other embodiments, the other players select the other cards 178*b*, 178*c*, 178*d* based on a predetermined order. For example, in the first round, the second player may get the first pick of the remaining cards, while the third player gets the second pick and the fourth player gets the third pick. Then, in the next round, the third player may pick first, the fourth player may pick second, and the second player picks third. In this example, the player that triggers the game always picks first. FIG. 6 illustrates which players were given (or selected) which of the other cards 178*b*, 178*c*, 178*d*. In other embodiments, there may be more cards 178 presented than players in the bonus game.

During the race, the secondary screen 16 displays the position of the player's car 172 relative to the other cars 176. In some embodiments, the bonus race may also be displayed on signage 200 (FIG. 10) that is external to the gaming machine 10.

The players continue to select cards until all of the players go around the board 174 at least once. In some embodiments, the players may make multiple laps around the board 174. In other embodiments, the game may end when the first player finishes a lap around the board 174. In yet other embodiments, the game continues until one or more players reach a predetermined position along the path, such as the finish position. In other alternative embodiments, the races are conducted in a series of rounds, where higher finishing players advance to compete in later rounds and lower finishing players are eliminated.

Figure 7:
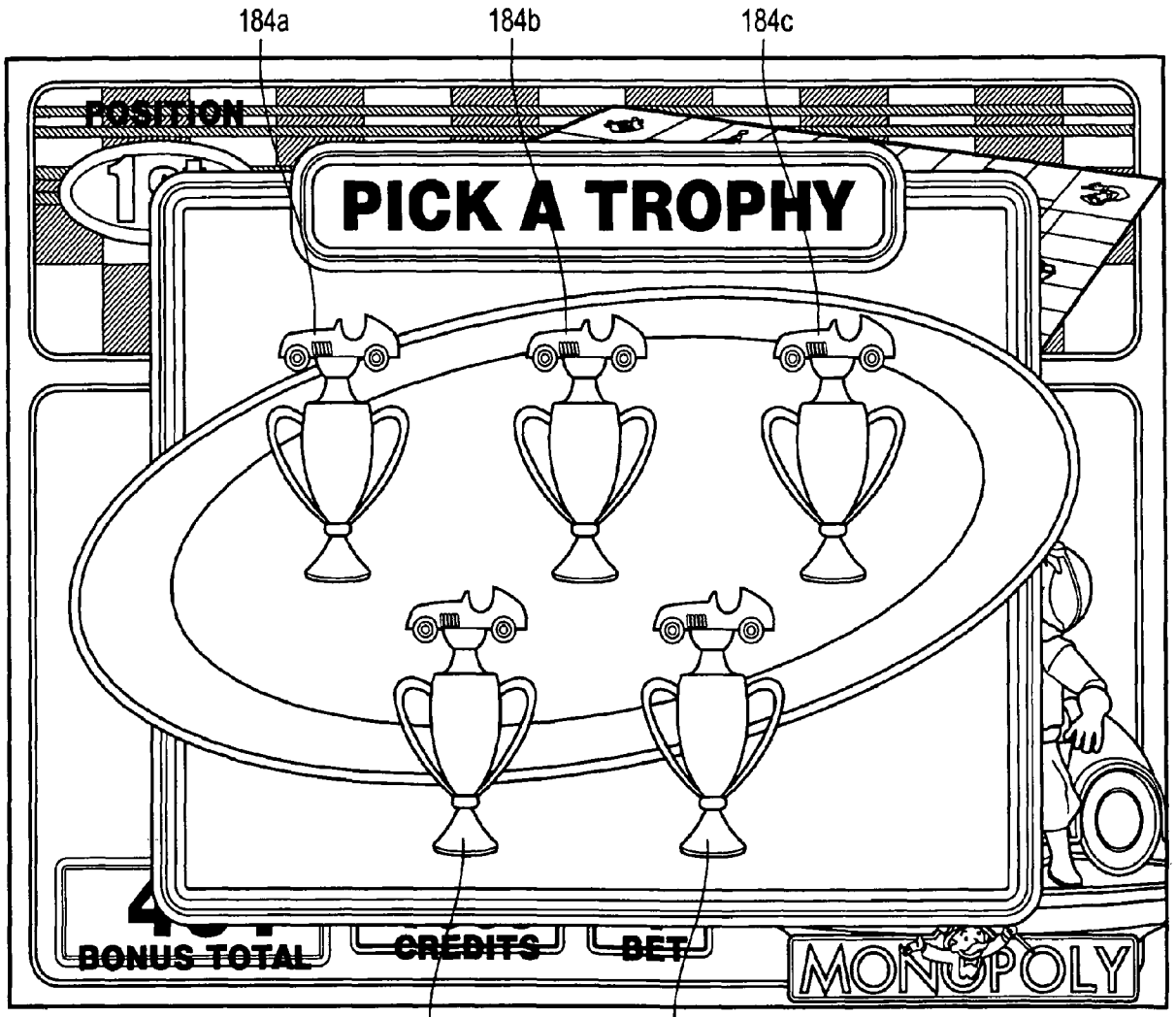
FIG. 7 is a subsequent display of the bonus game of FIG. 5.

In the illustrated embodiment, the players who come in first and second in the bonus game race are invited to compete in a championship race. The championship race is played in the same way as the first race: the players select player-selectable elements, e.g., cards, to advance his/her car 172, collecting properties and their respective awards along the way. Other cards are either selected by or passed out to the other player(s). The player who wins the championship race is directed to select a prize selection from a plurality of prize selections. In the embodiment of FIG. 7, the prize selections are a group of displayed trophies 184*a*, 184*b*, 184*c*, 184*d*, 184*e*. The trophies 184*a*, 184*b*, 184*c*, 184*d*, 184*e* contain a variety of prizes, including, but not limited to, credit awards, multipliers, and a "victory lap award," which is described below.

Figure 8:
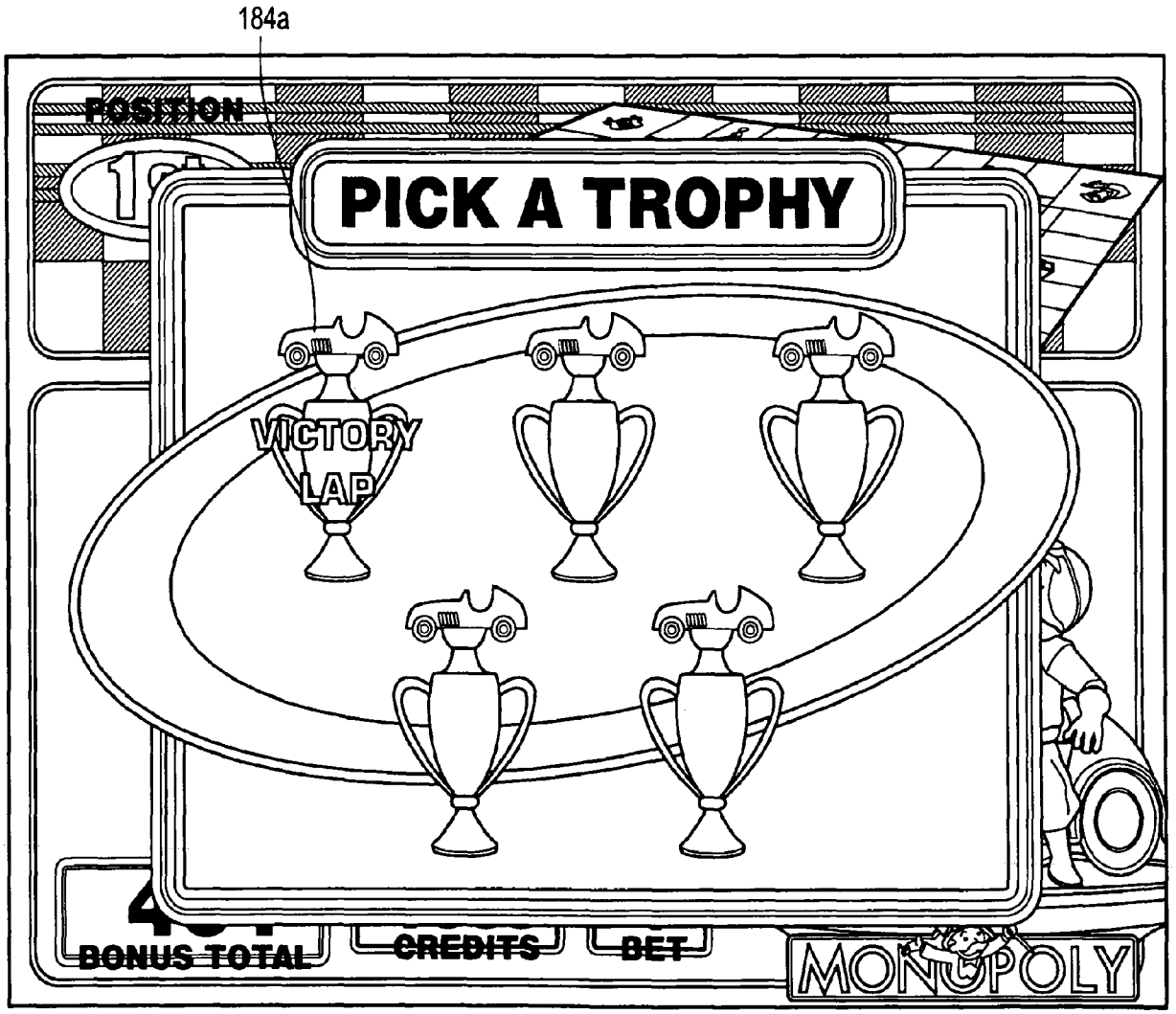
FIG. 8 is a subsequent display of the bonus game of FIG. 5.

As illustrated in FIG. 8, the winning player has selected trophy 184*a*, which reveals a prize of a "victory lap award." The "victory lap award" is a "win-all" award that grants the player all of the eligible prizes on the path of the board game 174, which in the MONOPOLY® game would include the prizes associated with each property on the board 174. As such, instead of accumulating just a few credits along the path, a player winning the championship race has the opportunity to win all of the credits that are available on the board 174, creating an added level of excitement as the player watches the credit amount tick upward.

Figure 9:
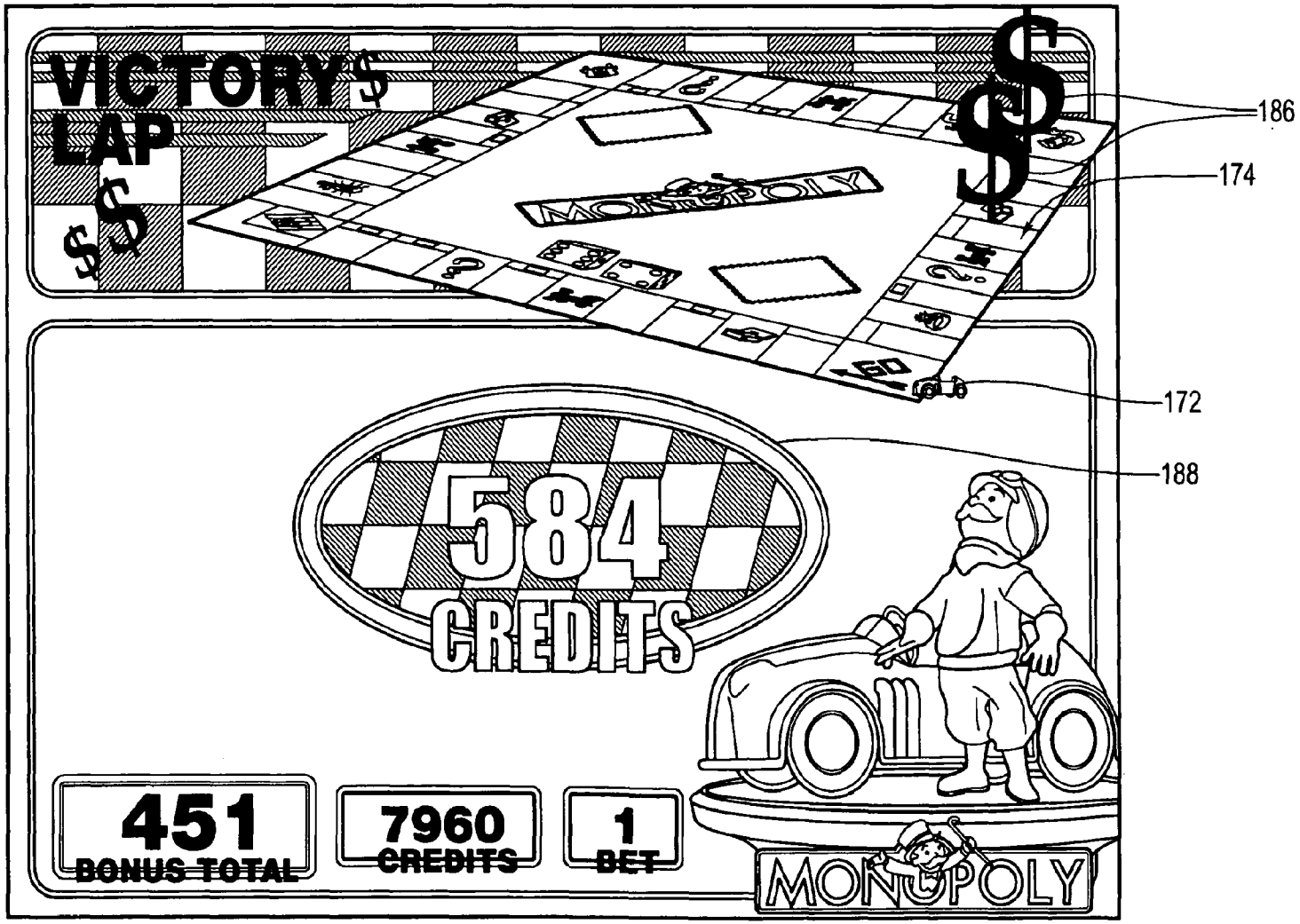
FIG. 9 is a subsequent display of the bonus game of FIG. 5.

As shown in FIG. 9, the player's car 172 travels around the board 174 in the "victory lap" award, accumulating credits, indicated both by the dollar signs 186 on the board 174 and a separate award indicator 188. The separate award indicator 188 can either display the final total that will be awarded, or the award indicator 188 can increase the winnings as the car 172 passes each property on the board 174, adding excitement.

In some embodiments, if a "victory lap" is won, then at least one of the primary display 14, secondary display 16, or the signage 200 that is common to the bank of gaming machines 10*a*, 10*b*, 10*c*, 10*d* (FIG. 10) show the winning car taking the "victory lap" around the entire board 174 and increasing the prize amount as the winning car passes each property. Displaying the "victory lap" would increase player excitement, since all participants can watch the player win a large award.

In other embodiments, the player may be awarded all of the prizes on the MONOPOLY® board by meeting a predetermined criterion other than winning the race and selecting a trophy. For example, the player may be awarded the "victory lap" prize by merely winning the race. In other embodiments, the predetermined criterion may be landing on a particular property. In yet other embodiments, players may be randomly selected to win the "victory lap" prize.

In the above-described embodiment, the bonus game is a two-tiered game, with players competing in a first level for prizes and some of the players continuing to a second level for additional prizes. The bonus game may also be a single-tier game, with the "victory lap" award being granted to the player who finishes the initial race first. Alternatively, the player who wins the initial race may then be granted a selection from a group of trophies as described in reference to the championship race.

Each of these embodiments and obvious variations thereof is contemplated as falling within the spirit and scope of the claimed invention, which is set forth in the following claims.

What is claimed is:

1. A gaming system comprising:

a plurality of gaming terminals for playing a plurality of wagering games;

an input device for receiving a wager to play at least one of the plurality of wagering games including a trail-based bonus game that is achieved in response to a bonus game triggering outcome in a basic game;

one or more processors configured to determine that one of the wagering games achieved the bonus game triggering outcome in the basic game and is playing the trail-based bonus game;

at least one of the one or more processors configured to enter at least another of the plurality of wagering games into the trail-based bonus game;

a display for displaying the trail-based bonus game, the trail-based bonus game including a plurality of elements along a trail, each of the plurality of elements having an associated award; and at least one memory device storing instructions that, when executed by the at least one of the one or more processors, cause the gaming system to:

in response to receiving a selection of one of the plurality of elements along the trail, crediting the award associated with the selected element to the wagering game associated with the received selection; and in response to one of the plurality of wagering games meeting a predetermined award-all criterion during the trail-based bonus game, awarding to the wagering game meeting the award-all criterion the associated award for all of the plurality of elements, wherein the wagering game is a two-stage trail-based bonus game, and a player is only eligible to meet the predetermined award-all criterion after successful completion of a first stage of the two-stage trail-based bonus game.

2. A method of playing a plurality of wagering games at a plurality of gaming machines, comprising:

conducting a wagering game at each of the plurality of gaming machines, the wagering games including a trail-based game that is achieved in response to a bonus game triggering outcome in a basic game, the trail-based game being a race;

determining, via one or more processors, that one of the plurality of wagering games achieved the bonus game triggering outcome in the basic game and is playing the trail-based game;

displaying a plurality of game elements along a trail, each of the game elements having an associated award;

entering, via at least one of the one or more processors, at least another of the plurality of wagering games into the trail-base bonus game;

in response to receiving a selection of one of the plurality of game elements along the trail, crediting the award associated with the selected element to the wagering game associated with the received selection;

in response to one of the wagering games achieving a predetermined award-all criterion, awarding all of the associated awards to the one wagering game achieving the criterion; and providing a plurality of prize selections to the one of the wagering games corresponding to a first player to finish the race.

3. A method of playing a wagering game on a gaming system, the method comprising:

conducting the wagering game at a plurality of gaming machines associated with the gaming system, the wagering game being a trail-based game;

displaying a plurality of player-selectable elements, the player-selectable elements having associated awards and location-related indicia that are associated with locations along the trail;

selecting, via a player at one of the plurality of gaming machines, one of the plurality of player-selectable elements;

in response to receiving the selection of one of the plurality of player-selectable elements, crediting the award associated with the selected element to the player at one of the plurality of gaming machines associated with the received selection;

assigning another of the plurality of player-selectable elements to one other of the plurality of gaming machines;

achieving, via another player at the one other of the plurality of gaming machines, a predetermined award-all criterion; and in response to achieving the predetermined award-all criterion, awarding the another player at the one other of the plurality of gaming machines the awards associated with all of the plurality of player-selectable elements along the trail.

4. The method of claim 3, wherein the assigning includes receiving a selection of another of the plurality of player-selectable elements by a player at another one of the plurality of gaming machines.

5. The method of claim 3, wherein the assigning includes selecting another of the plurality of player-selectable elements by a controller coupled to each of the plurality of gaming machines.

6. The method of claim 3, wherein the location-related indicia are numbers indicating the number of locations on the trail the player should move.

7. The method of claim 3, wherein the location-related indicia are images relating to the locations on the trail.

8. The method of claim 3, wherein the predetermined criterion is being the first player to finish the trail-based game, selecting an element, landing on a particular location in the game, or a combination thereof.

9. A method of playing a wagering game on a gaming system, comprising:

conducting the wagering game at a plurality of gaming machines associated with the gaming system, the wagering game including a plurality of trail-based bonus games;

displaying a first game of the plurality of trail-based bonus games, the first game including a plurality of selectable elements having associated awards and location-related indicia that are associated with locations along the trail;

selecting one of the plurality of selectable elements at one of the plurality of gaming machines;

in response to receiving the selection of one of the plurality of selectable elements, crediting the award associated with the selected element to a player at the gaming machine associated with the received selection;

in response to the gaming machine meeting a predetermined criterion in the first game, advancing to a second game of the plurality of trail-based bonus games;

achieving a predetermined award-all criterion in the second game of the plurality of trail-based bonus games, wherein eligibility for the predetermined award-all criterion occurs only after advancing to the second game; and in response to achieving the predetermined award-all criterion, crediting an award associated with all of the plurality of selectable elements along the trail to the player at the gaming machine associated with the achieved award-all criterion.

10. The method of claim 9, wherein the first game is a race and the predetermined criterion is finishing in the top two in the race.

11. The method of claim 9, wherein the predetermined criterion is met by achieving a particular number of credits.

12. The method of claim 9, wherein the first and second trail-based games are the same games and the associated awards of the second trail-based game are higher than the associated awards of the first trail-based game.

13. A gaming system of claim 1, comprising:

a plurality of gaming terminals for playing a plurality of wagering games;

an input device for receiving a wager to play at least one of the plurality of wagering games including a trail-based bonus game that is achieved in response to a bonus game triggering outcome in a basic game;

one or more processors configured to determine that one of the wagering games achieved the bonus game triggering outcome in the basic game and is playing the trail-based bonus game;

at least one of the one or more processors configured to enter at least another of the plurality of wagering games into the trail-based bonus game;

a display for displaying the trail-based bonus game, the trail-based bonus game including a plurality of elements along a trail, each of the plurality of elements having an associated award; and at least one memory device storing instructions that, when executed by the at least one of the one or more processors, cause the gaming system to:

in response to receiving a selection of one of the plurality of elements along the trail, crediting the award associated with the selected element to the wagering game associated with the received selection; and in response to one of the plurality of wagering games meeting a predetermined award-all criterion during the trail-based bonus game, awarding to the wagering game meeting the award-all criterion the associated award for all of the plurality of elements, wherein a selected one of the plurality of elements along the trail remains a selectable element available for selection by at least one of the other wagering games entered into the trail-based bonus game.

14. A gaming system comprising:

a plurality of gaming terminals for playing a plurality of wagering games;

an input device for receiving a wager to play at least one of the plurality of wagering games including a trail-based bonus game that is achieved in response to a bonus game triggering outcome in a basic game;

one or more processors configured to determine that one of the wagering games achieved the bonus game triggering outcome in the basic game and is playing the trail-based bonus game;

at least one of the one or more processors configured to enter at least another of the plurality of wagering games into the trail-based bonus game;

a display for displaying the trail-based bonus game, the trail-based bonus game including a plurality of elements along a trail, each of the plurality of elements having an associated award; and at least one memory device storing instructions that, when executed by the at least one of the one or more processors, cause the gaming system to:

in response to receiving a selection of one of the plurality of elements along the trail, crediting the award associated with the selected element to the wagering game associated with the received selection; and in response to one of the plurality of wagering games meeting a predetermined award-all criterion during the trail-based bonus game, awarding to the wagering game meeting the award-all criterion the associated award for all of the plurality of elements, wherein the trail-based game is a racing game and the act of awarding the associated award to the wagering game meeting the award-all criterion further includes at least one display displaying a player-element associated with the winning wagering game taking a victory lap along a trail of the trail-based bonus game.

* * * * *